United States Patent [19]

Thomas et al.

[11] Patent Number: 4,892,412

[45] Date of Patent: Jan. 9, 1990

[54] HEATABLE MIXER APPARATUS

[75] Inventors: David A. Thomas, Golden; Robert F. Karr, Wheatridge; Patricia K. Davies, Golden, all of Colo.

[73] Assignee: Adolph Motors COmpany, Golden, Colo.

[21] Appl. No.: 349,232

[22] Filed: May 9, 1989

[51] Int. Cl.[4] ..... B01F 15/06; B01F 9/02

[52] U.S. Cl. ..... 366/145; 366/146; 366/214; 422/104

[58] Field of Search ..... 366/144, 145, 146, 147, 366/148, 149, 22, 23, 24, 208, 213, 214, 218, 220, 232, 235, 200, 204; 94/348; 422/63, 64, 65, 104

[56] References Cited

U.S. PATENT DOCUMENTS 3,163,404 12/1964 Kraft ..... 366/214

4,479,720 10/1984 Mochida ..... 366/214

4,668,096 5/1987 Saaty ..... 366/144

*Primary Examiner*—Robert W. Jenkins

*Attorney, Agent, or Firm*—Klaas & Law

[57] ABSTRACT

A heatable mixer apparatus comprising an open-top tank having a liquid therein and a wheel rotatably mounted essentially perpendicularly above the tank with a portion thereof disposed within the tank. On the lateral sides of the wheel are a plurality of retainers which releasably retain closable vessels containing materials to be mixed. A heater is provided within the tank to heat the liquid to a desired temperature. In operation, the liquid is heated, vessels containing materials to be mixed are placed in respective retainers, and the wheel is rotated to thereby permit mixing of the materials and simultaneous heating as the vessels travel through the heated liquid in the tank.

9 Claims, 2 Drawing Sheets

HEATABLE MIXER APPARATUS

BACKGROUND OF THE INVENTION

This invention relates to a mixer apparatus, and in particular to a rotary mixer apparatus having integral therewith an open top tank wherein a liquid can be housed and heated and wherein materials being mixed can be simultaneously heated as they travel through the heated liquid.

It is many times desirable to simultaneously mix and heat materials in order to place these materials in condition for further treatment, testing, or the like. When a flowable material such as a liquid or a quantity of discrete particles is to be mixed and heated, one common apparatus employed is a stirring propeller disposed within a vessel housing the flowable material. This propeller can be secured at the end of a rotatable shaft which enters the vessel, or it can be a magnetized propeller or stirring bar whose rotation can be controlled exteriorly from the vessel. The vessel itself can be heated by placing it on a hot plate or in a tank such as a water bath containing heated liquid.

As is evident, however, employing mixing vessels which are stationary, either on hot plates or within a tank, significantly reduces the number of vessels which can be heated at one time. Further, because of the usual size of a stirring bar or propeller, the size of the vessel must be relatively large in order to accommodate both the bar or propeller and the amount of material required to render an adequate volume of medium for effective stirring. Inherent in the latter requirement is the usual inability to adequately mix relatively small amounts of material.

It is therefore a primary object of the present invention to provide a heatable mixer apparatus where heating and mixing of relatively small amounts of material can be accomplished without propellers or stirring bars. Another object of the present invention is to provide a heatable mixer apparatus whereby a plurality of mixing vessels can be subjected to mixing and heating in a relatively small planar space. Yet another object of the present invention is to provide a heatable mixer apparatus wherein mixing speed as well as temperature can be selectively controlled, and wherein heat is provided by a liquid heated within an open top tank through which materials to be mixed and heated travel. These and other objects of the invention will become apparent throughout the description which now follows.

SUMMARY OF THE INVENTION

The present invention is a heatable mixer apparatus comprising an open top tank having a liquid therein and a wheel means for supporting a plurality of retainer means and rotatably mounted essentially perpendicularly above the tank with a portion of the wheel means disposed within the tank. The tank has heater means for selectively heating and regulating the temperature of liquid within the tank, and the wheel means has rotation means for rotating the wheel means and regulating the speed of rotation. Mounted on at least one of the lateral surfaces of the wheel means are the plurality of retainer means for releasably holding closable vessels into which materials to be heated and mixed can be placed. A removable enclosure means for enclosing the portion of the wheel means not disposed within the tank can be provided. In operation, water or other suitable liquid is placed in the tank and brought to the desired temperature, closed vessels containing material to be mixed and heated are retained by the retainer means on the wheel means, and wheel means rotation is then effectuated. In this manner, a relatively large number of relatively small quantities of specimens can be heated and mixed simultaneously in a relatively small planar space without any requirement for special stirring devices.

BRIEF DESCRIPTION OF THE DRAWINGS

An illustrative and presently preferred embodiment of the invention is shown in the accompanying drawings in which.

DETAILED DESCRIPTION OF A PREFERRED EMBODIMENT

Figure 1:
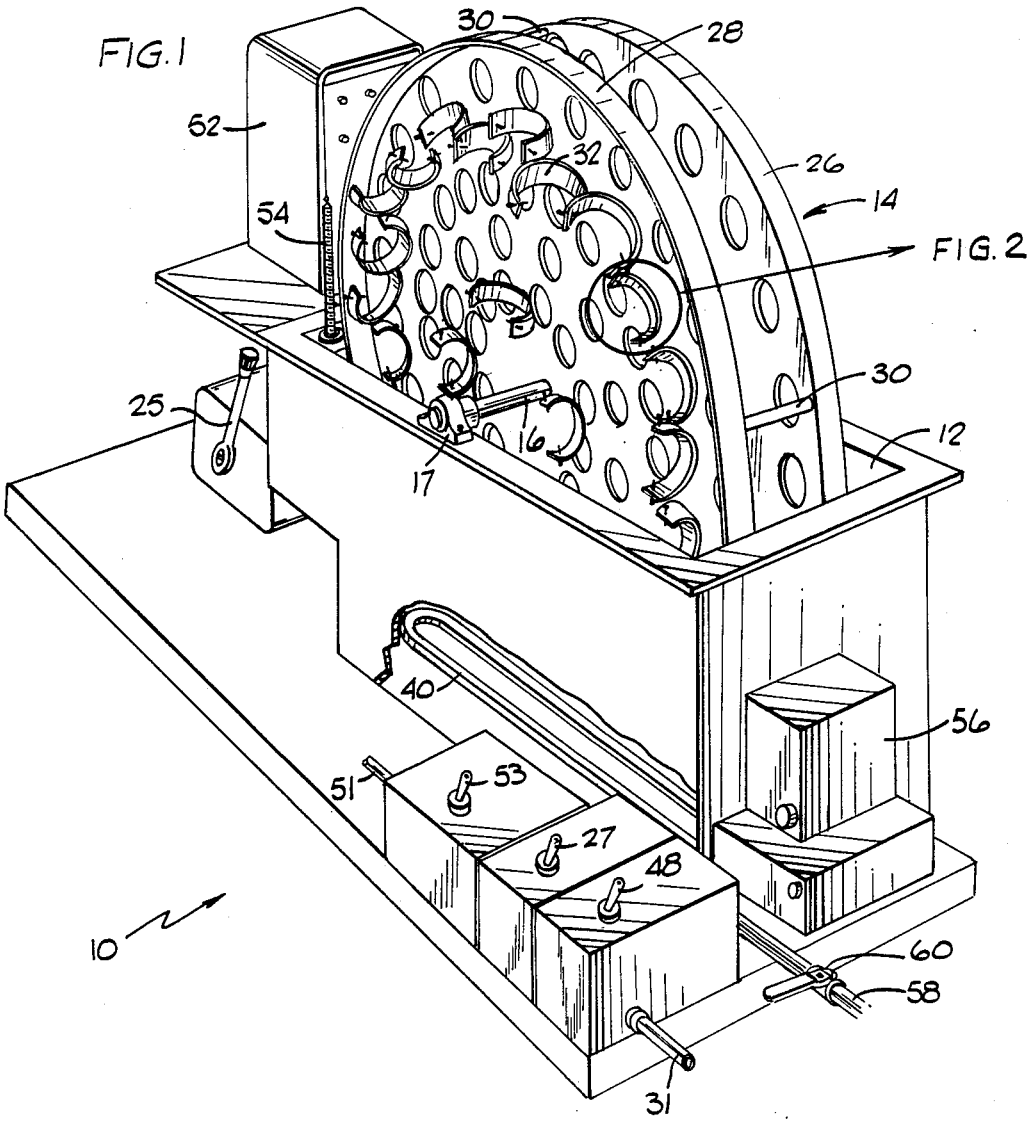
FIG. 1 is a front perspective view, partially broken away, of a mixer apparatus.
Figure 4:
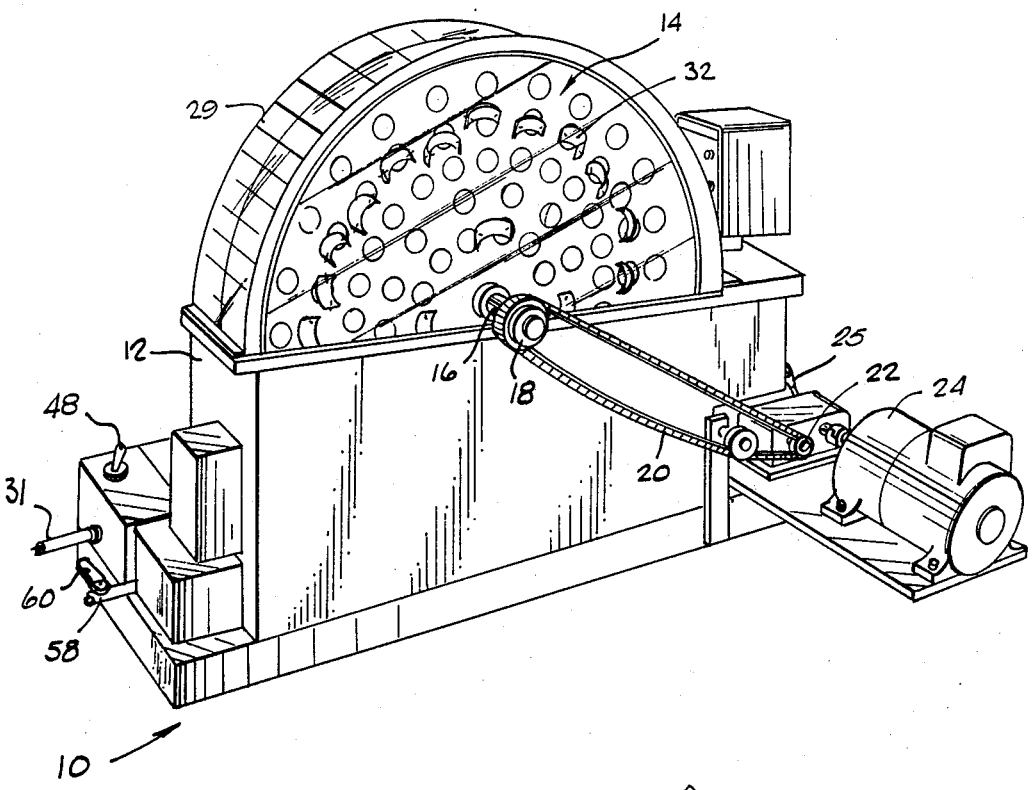
FIG. 4 is a rear perspective view of the mixer apparatus of FIG. 1.
Figure 5:
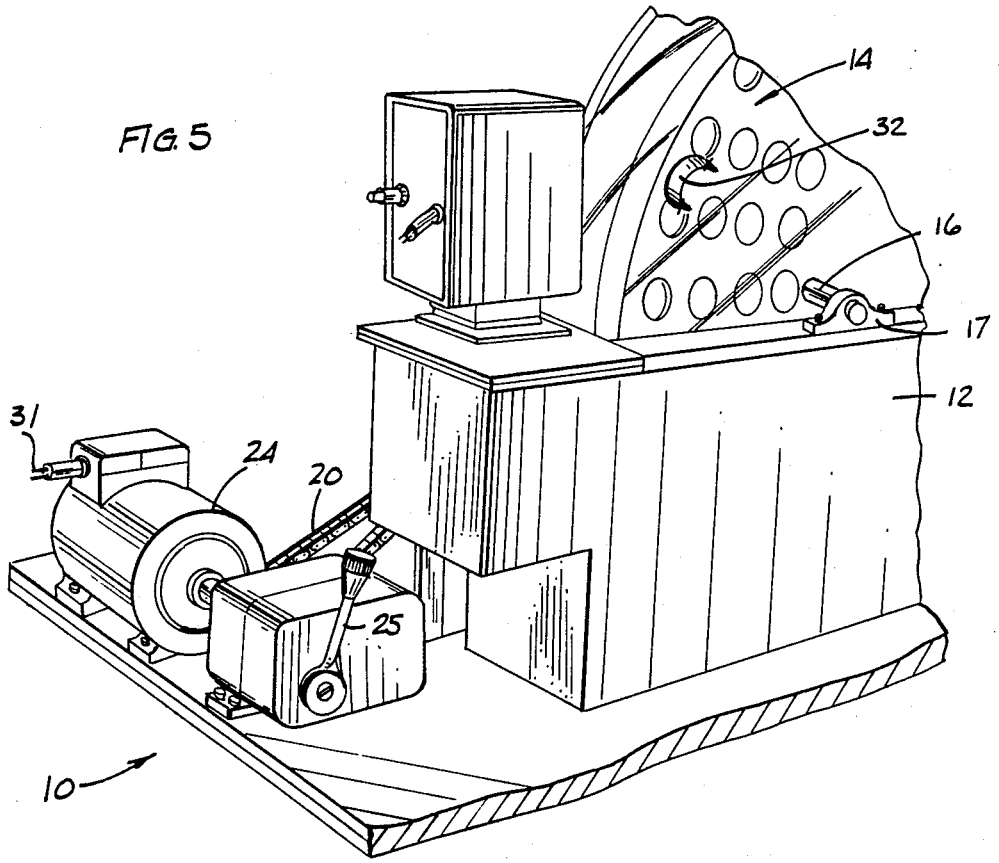
FIG. 5 is an enlarged perspective partial view of one end of the mixer apparatus of FIG. 1.

The present invention is a heatable, rotary mixer apparatus having heater means for selectively heating and regulating mixing temperature, and speed control means for maintaining and regulating the mixing speed of materials to be mixed. Referring to FIGS. 1, 4 and 5, the mixer apparatus 10 comprises an open top tank 12 and a wheel means 14 rotatably mounted perpendicularly above the tank 12 with a portion thereof disposed within the tank 12. The wheel means 14 is provided with an axial shaft 16 in a pillow block bearing 17, and has a lateral sprocket member 18 which engages a roller chain 20 engaged with a like sprocket member 22 integral with a conventional electric drive motor 24 having a conventional power switch 48 in power cord 31 communication with the motor 24. A conventional variable-speed gear box 25 in communication with the drive motor 24 permits selection and regulation of revolution speed of the wheel means 14. In the embodiment here shown, the wheel means 14 comprises two rimmed, parallel, perforated disks 26, 28 spaced from each other and joined to each other by a plurality of cross spacers 30 extending between the respective peripheries of the disks 26, 28. The disks 26, 28 preferably are perforated in order to reduce their weight. Optionally, a cover 29, here constructed of a clear polycarbonate material, can enclose the exposed portion of the wheel means 14 as shown in FIG. 4.

Figure 2:
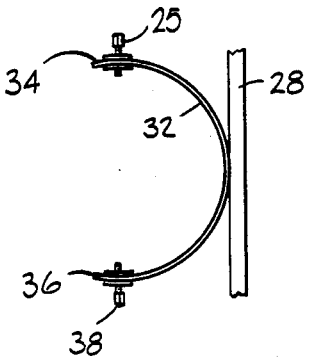
FIG. 2 is an enlarged side elevation view of a U-shaped bracket from FIG. 1.
Figure 3:
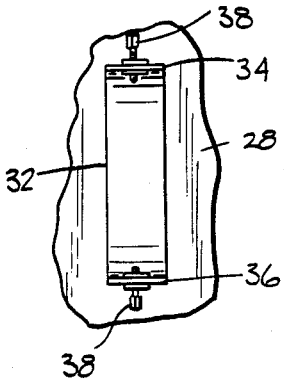
FIG. 3 is a front elevation view of the bracket of FIG. 2.

On the outer lateral side of each disk 26, 28 are mounted a plurality of U-shaped brackets 32 as shown in detail in FIGS. 2 and 3. Each end 34, 36 of each bracket 32 is provided with a threaded opening in which opposing threaded screws 38 reside. A closed vessel (not shown) containing material to be mixed is placed between the ends 34, 36 of the bracket 32, and the screws 3S then are tightened against the vessel to accomplish a friction-fit retention thereof. As is apparent, a plurality of vessels can be so retained simultaneously.

Situated on the floor of the tank 12 is a 1500-watt primary electric heating element 40 in conventional communication with a power switch 27. Conventionally integral within the circuitry between the heating element 40 and the power switch 27 is a conventional surface-mount thermostat 56 for maintenance of temperature of liquid within the tank 1. A 1000-watt combination heater/circulating pump 52 extends into the tank 12, and is in conventional power cord 51 communication with a power switch 53. In the embodiment here shown, the pump 52 is manufactured by Haake Company, Berlin, West Germany, type no. 000-5728. A standard stem thermometer 54 extends into the tank to permit temperature monitoring. A drain line 58 with a ball valve 60 permits liquid removal from the tank 12.

In operation, a liquid such as water is placed in the tank 12 and power to the heating element 40 and pump 52 is provided. When the desired liquid temperature is reached, closed vessels containing materials to be heated and mixed are secured to respective brackets 32, and the motor 24 is activated to rotate the wheel means 14 at a rotation speed as selected through the gear box 25. The vessels containing the materials to be heated and mixed move through the heated liquid in the tank 12 for such heating. Simultaneously, the materials within the vessels are mixed as a result of the continuous upside-down and rightside-up movement of these vessels. Because a relatively large number of mixing vessels can be employed simultaneously, and because the vessels themselves or their content amount can be relatively small, the present mixer apparatus permits great versatility and concurrent heating and mixing treatment.

EXAMPLE

A large number of barley varieties for use in the commercial preparation of beer must be collected each year and subsequently micro-malted and tested to analyze for important melting characteristics. These procedures require the mixing and heating of a plurality of small amounts of materials, and this requirement can be readily accomplished employing the mixer apparatus herein described.

To exemplify the utility of the mixer apparatus in malt preparation, the tank 12 was filled with water and the heating element 40 and heater/circulating pump 52 were powered to raise the temperature of the water in the tank 12 to 46° C. Simultaneously, a plurality of 50 ml-size polycarbonate tubes had introduced therein 8.0 grams of finely-ground malt and 48 ml of water which had been pre-heated to 46° C. The tubes were plugged and secured to respective brackets 32 as described above, and wheel rotation at about 15 rpm was initiated. The temperature of the water in the tank 12 was maintained at 46° C. for 30 minutes, then raised at 1° C. per minute for 25 minutes to a temperature of 71° C. This temperature was maintained for one hour while wheel rotation continued to thereby uniformly mix and heat the contents of the tubes. Thereafter, heating of the water in the tank 12 was stopped and cold water was introduced into the tank 12 while hot water therein was simultaneously drained to thereby reduce water temperature to 20°–25° C. to cool the rotating samples. After cooling, rotation was stopped and the tubes were removed from the respective brackets. The tubes were dried to remove any excess water, and their contents were brought to a weight of 36 grams by the addition of water with a pipette. Each sample was well shaken by hand and poured into a funnel fitted with filter paper. After the first 5 ml of filtrate was collected, it was returned to the funnel and filtration continued for one hour. Thereafter, each sample was collected and injected into a densitometer for determination of specific gravity. The values obtained were compared to those gathered on identical 50-gram sample portions treated according to the standard American Society of Brewing Chemists (ASBC) analysis method which employs large vessels having propeller stirring blades within. It was found that the standard deviation employing the mixer apparatus herein described was 0.4, while the standard deviations found employing the standard ASBC method were, on two separate occasions, 0.3 and 0.5. It is therefore apparent that the present mixer apparatus, which requires as little as 8 grams of sample material, compares most favorably to the standard ASBC method which requires 50 grams of sample material and, of course, a correspondingly greater equipment size.

While an illustrative and presently preferred embodiment of the invention has been described in detail herein, it is understood that the inventive concepts may be otherwise variously embodied and employed and that the appended claims are intended to be construed to include such variations except insofar as limited by the prior art.

What is claimed is:

1. A heatable mixer apparatus comprising:

(a) an open-top tank wherein a liquid can be housed;

(b) a wheel means for supporting a plurality of retainer means mounted thereon for releasably holding closed vessels into which materials to be mixed can be placed, said wheel means rotatably mounted essentially perpendicularly above the tank with a portion thereof disposed within the tank;

(c) heater means for heating and regulating the temperature of liquid within the tank; and (d) rotation means for rotating the wheel means.

2. The apparatus as claimed in claim 1 wherein the retainer means comprises a U-shaped bracket having at each end thereof a threaded opening wherein opposing threaded screws are disposed for releasably holding a vessel placed therebetween.

3. The apparatus as claimed in claim 2 wherein the plurality of retainer means are mounted on at least one exposed lateral side of the wheel means.

4. The apparatus as claimed in claim 3 wherein the wheel means comprises two parallel concentrically disposed disks spaced from each other.

5. The apparatus as claimed in claim 1 wherein the wheel means comprises two parallel concentrically disposed disks spaced from each other.

6. The apparatus as claimed in claim 1 wherein the heater means comprises an electrically powered heating element disposed within the tank.

7. The apparatus as claimed in claim 6 wherein a thermostat means is in communication with the electrically powered heating element for controlling the temperature of said heating element.

8. The apparatus as claimed in claim 1 wherein the rotation means comprises an electrically powered drive motor in communication with the wheel means.

9. The apparatus as claimed in claim 8 and wherein a variable speed gear means for regulating rotation speed of the wheel means is in communication with the drive motor.

* * * * *

UNITED STATES PATENT AND TRADEMARK OFFICE

CERTIFICATE OF CORRECTION

PATENT NO. : 4,892,412

DATED : January 9, 1990

INVENTOR(S) : David A. Thomas et al.

It is certified that error appears in the above-identified patent and that said Letters Patent is hereby corrected as shown below:

On the Title Page:

The Assignee is listed as "Adolph Motors COmpany" and should read --Adolph Coors Company--.

Column 2, line 61, "screws 3S" should read --screws 38--.
Column 3, line 3, "tank 1" should read --tank 12--; and
line 35, "melting" should read --malting--.

Signed and Sealed this

Twenty-fifth Day of December, 1990

*Attest:*

HARRY F. MANBECK, JR.

*Attesting Officer*

*Commissioner of Patents and Trademarks*